US012589428B2

(12) United States Patent
Morijiri et al.

(10) Patent No.: US 12,589,428 B2
(45) Date of Patent: Mar. 31, 2026

(54) LOCK REGULATION MECHANISM FOR A BINDING MACHINE

(71) Applicant: MAX CO., LTD., Tokyo (JP)

(72) Inventors: Takeshi Morijiri, Tokyo (JP); Osamu Itagaki, Tokyo (JP); Shinpei Sugihara, Tokyo (JP)

(73) Assignee: Max Co., Ltd., Tokyo (JP)

( * ) Notice: Subject to any disclaimer, the term of this patent is extended or adjusted under 35 U.S.C. 154(b) by 192 days.

(21) Appl. No.: 18/238,673

(22) Filed: Aug. 28, 2023

(65) Prior Publication Data

US 2024/0075516 A1 Mar. 7, 2024

(30) Foreign Application Priority Data

Sep. 2, 2022 (JP) ..... 2022-139999

(51) Int. Cl.
*B21F 23/00* (2006.01)
*B21F 7/00* (2006.01)
*B21F 15/04* (2006.01)

(52) U.S. Cl.
CPC ..... *B21F 23/005* (2013.01); *B21F 7/00* (2013.01); *B21F 15/04* (2013.01)

(58) Field of Classification Search
CPC ..... B21F 15/00; B21F 15/02; B21F 15/04; B21F 7/00; B65B 13/22; B65B 13/28; B65B 13/285; B65B 13/025; B65B 13/04; B65B 13/06; B65B 27/10; B25B 25/00; E04G 21/123; E04G 21/122
See application file for complete search history.

(56) References Cited

U.S. PATENT DOCUMENTS

2017/0335582 A1 11/2017 Machida et al.
2018/0155940 A1 6/2018 Nagaoka et al.
2020/0254508 A1* 8/2020 Yoshida ..... B21F 15/04
2020/0270881 A1 8/2020 Machida et al.
(Continued)

FOREIGN PATENT DOCUMENTS

JP 2017-172111 A 9/2017
JP 2017-206302 A 11/2017
(Continued)

OTHER PUBLICATIONS

Translation of WO-2021070481.*
Translation of JP-6726988.*
Jan. 30, 2024—(EP) Extended Search Report—EP App 23193765.7.

*Primary Examiner* — Bobby Yeonjin Kim
(74) *Attorney, Agent, or Firm* — Banner & Witcoff, Ltd.

(57) ABSTRACT

A binding machine includes a magazine including an accommodation part configured to accommodate a reel, and a lid part configured to cover the accommodation part to be openable and closable, a wire feeding unit configured to feed the wire in a forward direction in which the wire is pulled out from the magazine and in a reverse direction in which the wire is pulled back to the magazine, a curl forming unit configured to form a path along which the wire fed in the forward direction is to be wound around an object, a binding unit configured to twist the wire fed in the reverse direction and wound on the object, and a plurality of regulating portions configured to regulate opening of the lid part from a closed state in which the accommodation part is closed by the lid.

11 Claims, 11 Drawing Sheets

(56) References Cited

U.S. PATENT DOCUMENTS

| | | | | |
|---|---|---|---|---|
| 2020/0399914 | A1 | 12/2020 | Nagaoka et al. | |
| 2021/0245905 | A1* | 8/2021 | Yoshida | B65B 13/025 |
| 2022/0325543 | A1 | 10/2022 | Matsuno et al. | |
| 2023/0003039 | A1 | 1/2023 | Nagaoka et al. | |
| 2023/0158649 | A1* | 5/2023 | Okamura | B25B 25/00 140/93.2 |

FOREIGN PATENT DOCUMENTS

| | | | | |
|---|---|---|---|---|
| JP | 6726988 | B2 * | 7/2020 | |
| JP | 6763385 | B2 | 9/2020 | |
| WO | WO-2021070481 | A1 * | 4/2021 | E04G 21/123 |

* cited by examiner

LOCK REGULATION MECHANISM FOR A BINDING MACHINE

CROSS-REFERENCE TO RELATED APPLICATIONS

The present application claims priority from Japanese Patent Application No. 2022-139999 filed on Sep. 2, 2022, the entire content of which is incorporated herein by reference.

TECHNICAL FIELD

The present invention relates to a binding machine configured to bind a to-be-bound object such as a reinforcing bar with a wire.

BACKGROUND ART

In the related art, suggested is a binding machine referred to as a reinforcing bar binding machine that winds a wire around two or more reinforcing bars and twists the wire wound around the reinforcing bars to bind the two or more reinforcing bars with the wire.

A reinforcing bar binding machine in the related art has a configuration in which a wire is fed with a wire feeding unit, wound around a reinforcing bar, and then twisted to bind the reinforcing bar. Regarding such a reinforcing bar binding machine, suggested is a reinforcing bar binding machine that feeds a wire in a forward direction, winds the wire around a reinforcing bar, feeds the wire in a reverse direction, winds the wire on the reinforcing bar, cuts the wire, and twists a place where one end portion side and the other end portion side of the wire intersect to bind a reinforcing bar (for example, refer to Japanese Patent No. 6763385).

In the reinforcing bar binding machine described in Patent Literature 1, a magazine in which a reel having a wire wound thereon is accommodated is provided with a lock lever for pressing a cover from the outside. The lock lever extends along a surface of the cover. In addition, the cover is provided with a pressing portion firmly pressed by the lock lever.

In the operation of feeding the wire in the reverse direction in order to wind the wire on the reinforcing bar, there is a possibility that the wire loosened in the magazine will cause buckling. If the wire loosened in the magazine causes buckling, there is a possibility that the wire deforms in a direction approaching the cover and pushes the cover in an opening direction.

Thereby, there is a possibility that a gap may occur between the cover and the case at a portion that is not pressed by the lock lever. When a gap occurs between the cover and the case, the reel moves toward the cover in an axis direction of rotation as much as the gap, which may cause malfunctions in operation.

The present invention has been made in view of the above problem, and an object thereof is to provide a binding machine configured such that a lid part of a magazine is not pushed and opened by a wire.

SUMMARY

According to an aspect of the invention, a binding machine includes a magazine including an accommodation part configured to accommodate a reel on which a wire is wound, and a lid part configured to cover the accommodation part to be openable and closable, a wire feeding unit configured to feed the wire in a forward direction in which the wire is pulled out from the magazine and in a reverse direction in which the wire is pulled back to the magazine, a curl forming unit configured to form a path along which the wire fed in the forward direction by the wire feeding unit is to be wound around an object, a binding unit configured to twist the wire fed in the reverse direction and wound on the object by the wire feeding unit, and a plurality of regulating portions configured to regulate opening of the lid part from a closed state in which the accommodation part is closed by the lid.

In the present invention, by regulating opening of the lid part having closed the accommodation part from the closed state at a plurality of locations, a gap is suppressed from occurring between the lid part and the accommodation part even when the lid part is pushed in an opening direction by the reel or wire.

According to another aspect of the invention, a binding machine includes a magazine having an accommodation part configured to accommodate a reel on which a wire is wound, and a lid part configured to cover the accommodation part to be openable and closable, a wire feeding unit configured to feed the wire in a forward direction in which the wire is pulled out from the magazine and in a reverse direction in which the wire is pulled back to the magazine, a curl forming unit configured to form a path along which the wire fed in the forward direction by the wire feeding unit is to be wound around an object, a binding unit configured to twist the wire fed in the reverse direction and wound on the object by the wire feeding unit, and a regulating portion provided on a downstream side of an axis of rotation of the reel in a feeding path of the wire that is fed in a forward direction, and configured to regulate opening of the lid part from a closed state in which the accommodation part is closed by the lid.

In the present invention, by regulating opening of the lid part having closed the accommodation part from the closed state on the downstream side of the axis of rotation of the reel with respect to the feeding path of the wire that is fed in the forward direction, a gap is suppressed from occurring between the lid part and the accommodation part even when the lid part is pushed in an opening direction by the reel or wire.

According to the present invention, even when the lid part is pushed in an opening direction by the reel or wire, a gap is suppressed from occurring between the lid part and the accommodation part, and the reel is suppressed from moving in the axis direction of rotation toward the lid part in the magazine.

DESCRIPTION OF EMBODIMENTS

Hereinafter, an example of a reinforcing bar binding machine as an embodiment of the binding machine of the present invention will be described with reference to the drawings.

Figure 1A:
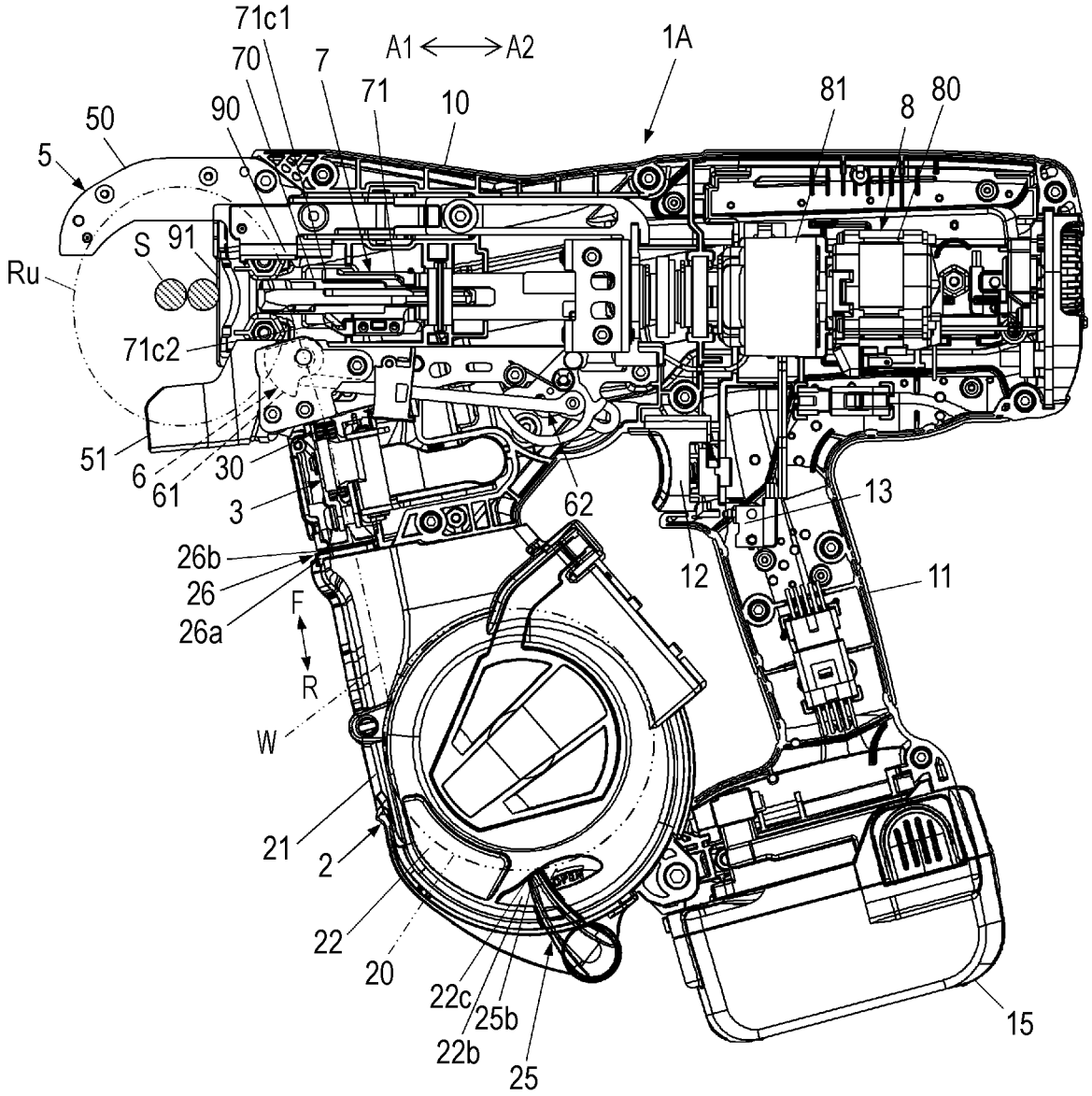
FIG. 1A is a configuration view showing an example of an overall configuration of a reinforcing bar binding machine of the present embodiment, in a state in which a cover is detached, as seen from a side.
Figure 1B:
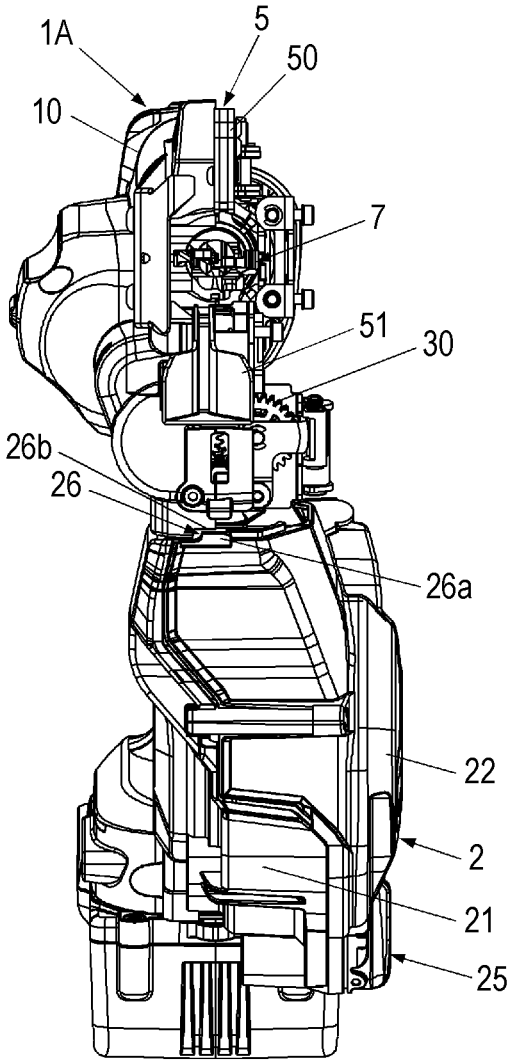
FIG. 1B is a configuration view showing the example of the overall configuration of the reinforcing bar binding machine of the present embodiment, in the state in which the cover is detached, as seen from front.
Figure 2A:
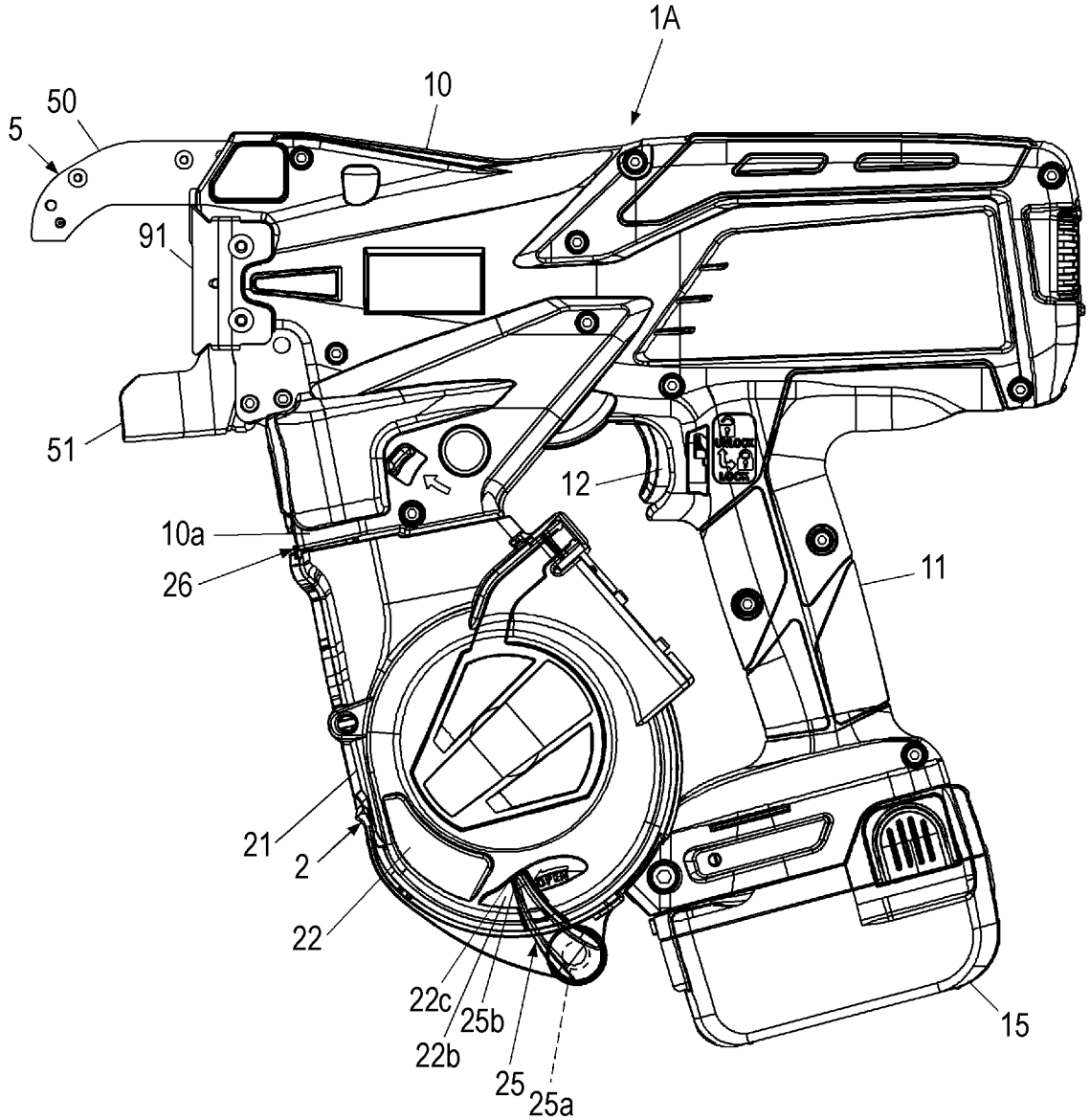
FIG. 2A is a configuration view showing the example of the overall configuration of the reinforcing bar binding machine of the present embodiment, as seen from a side.
Figure 2B:
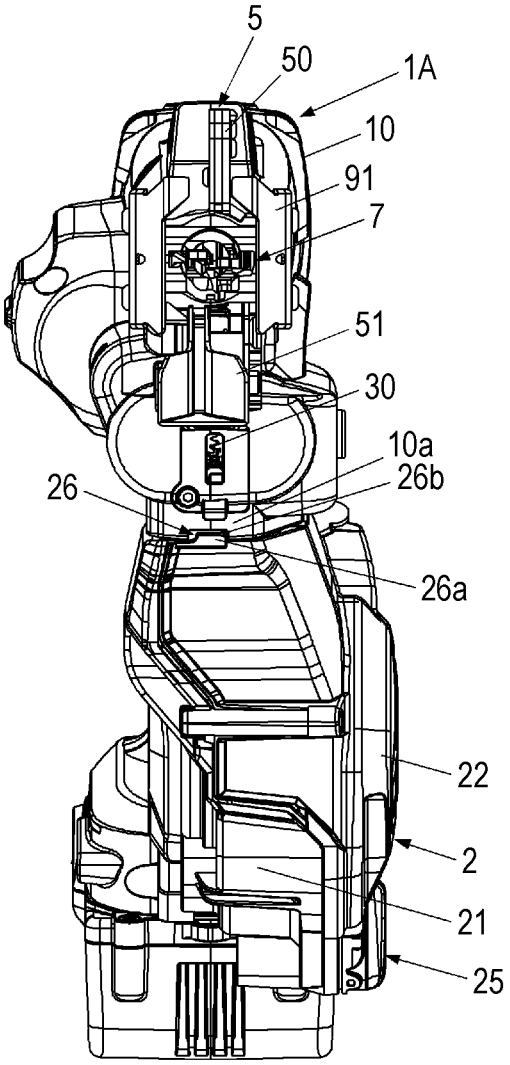
FIG. 2B is a configuration view showing the example of the overall configuration of the reinforcing bar binding machine of the present embodiment, as seen from front.

Configuration Example of Reinforcing Bar Binding Machine of Present Embodiment FIG. 1A is a configuration view showing an example of an overall configuration of a reinforcing bar binding machine of the present embodiment, in a state in which a cover is detached, as seen from a side, and FIG. 1B is a configuration view showing the example of the overall configuration of the reinforcing bar binding machine of the present embodiment, in the state in which the cover is detached, as seen from front. In addition, FIG. 2A is a configuration view showing the example of the overall configuration of the reinforcing bar binding machine of the present embodiment, as seen from a side, and FIG. 2B is a configuration view showing the example of the overall configuration of the reinforcing bar binding machine of the present embodiment, as seen from front.

A reinforcing bar binding machine 1A feeds a wire W in a forward direction denoted with an arrow F, winds the wire around reinforcing bars S, which are a to-be-bound object, feeds the wire W wound around the reinforcing bars S in a reverse direction denoted with an arrow R, winds the wire on the reinforcing bars S, cuts the wire, and twists the wire W, thereby binding the reinforcing bars S with the wire W.

The reinforcing bar binding machine 1A includes a magazine 2 in which the wire W is accommodated, and a wire feeding unit 3 that feeds the wire W, so as to implement the above-described functions. In addition, the reinforcing bar binding machine 1A includes a curl forming unit 5 that forms a path along which the wire W fed by the wire feeding unit 3 is to be wound around the reinforcing bars S, and a cutting unit 6 that cuts the wire W wound on the reinforcing bars S. In addition, the reinforcing bar binding machine 1A includes a binding unit 7 that twists the wire W wound on the reinforcing bars S, and a drive unit 8 that drives the binding unit 7.

Further, the reinforcing bar binding machine 1A has such a form that an operator grips and uses with a hand, and has a main body part 10 and a handle part 11.

In the magazine 2, a reel 20 on which the long wire W is wound to be reeled out is rotatably and detachably accommodated. For the wire W, a wire made of a plastically deformable metal wire, a wire having a metal wire covered with a resin, or a twisted wire is used.

In a configuration in which the reinforcing bars S are bound with one wire W, one wire W is wound on a hub part (not shown) of the reel 20, and one wire W can be pulled out while the reel 20 rotates. In addition, in a configuration in which the reinforcing bars S are bound with a plurality of wires W, the plurality of wires W are wound on the hub part, and the plurality of wires W can be pulled out at the same time while the reel 20 rotates. For example, in a configuration in which the reinforcing bars S are bound with two wires W, the two wires W are wound on the hub part, and the two wires W can be pulled out at the same time while the reel 20 rotates.

Figure 3A:
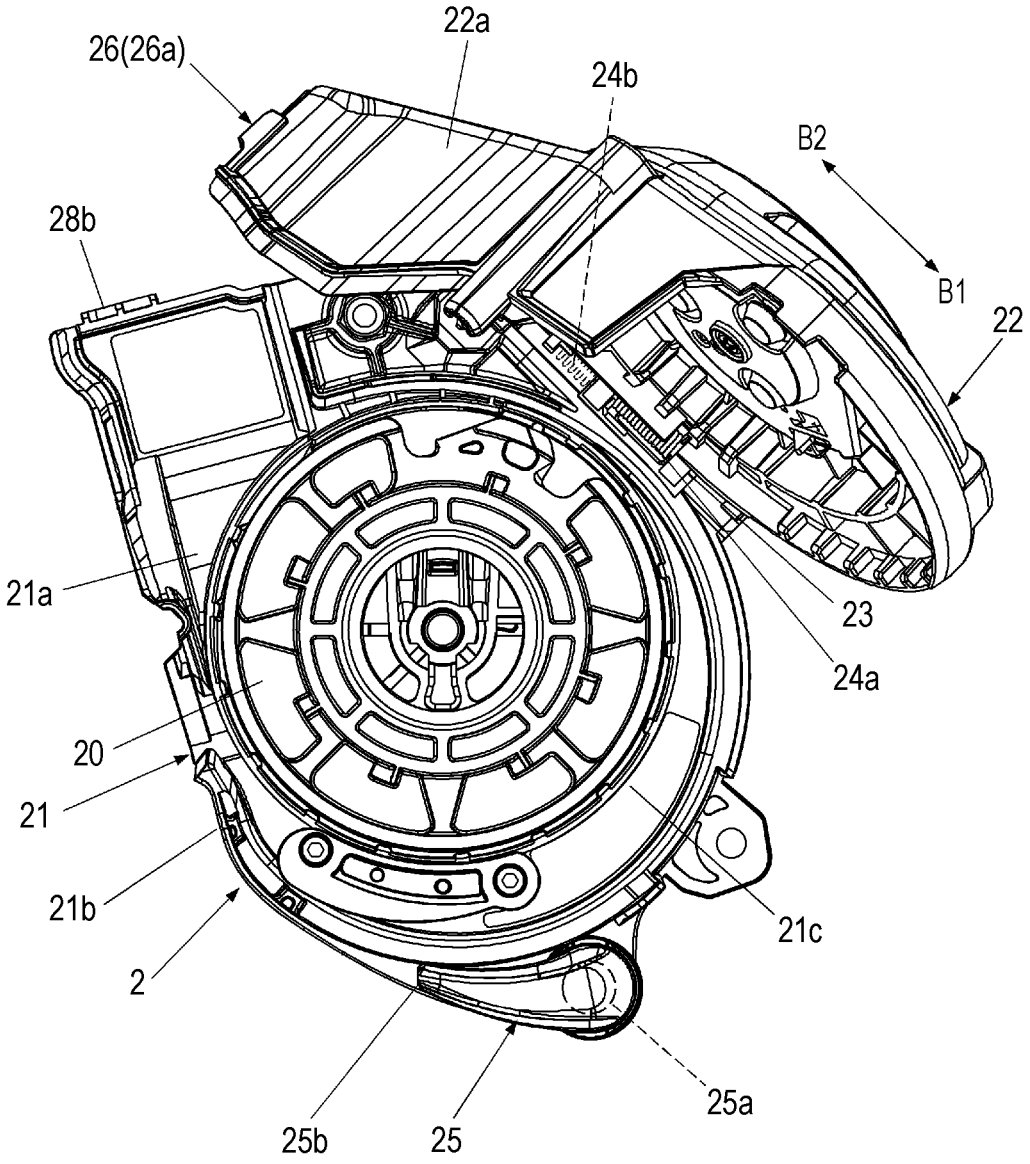
FIG. 3A is a side view showing an example of a magazine according to the present embodiment.
Figure 3B:
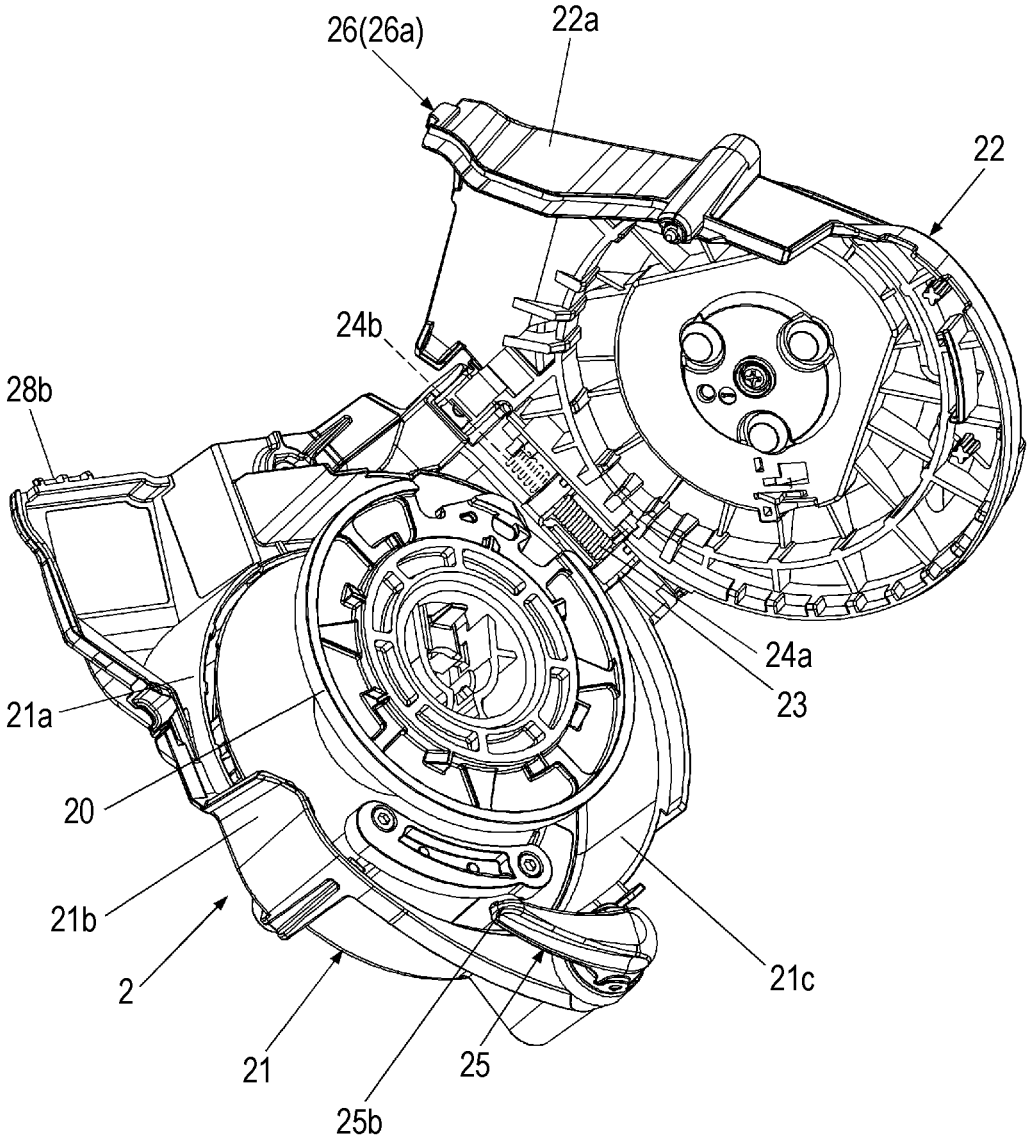
FIG. 3B is a perspective view showing the example of the magazine according to the present embodiment.

FIG. 3A is a side view showing an example of a magazine according to the present embodiment, FIG. 3B is a perspective view showing the example of the magazine according to the present embodiment, and FIGS. 4A to 4D are exploded perspective views showing an example of a regulating portion of the present embodiment for regulating the magazine in a closed state. Subsequently, a configuration of the magazine 2 according to the present embodiment and a configuration of the regulating portion according to the present embodiment for regulating the magazine 2 in a closed state will be described with reference to the respective drawings.

The magazine 2 includes an accommodation part 21 in which the reel 20 is accommodated, and a lid part 22 that covers the accommodation part 21 to be openable/closable.

The accommodation part 21 is attached to the main body part 10. The accommodation part 21 includes a side wall portion 21*a* that closes a side portion on one side along an axis of rotation of the reel 20, and a circumferential wall portion 21*b* that is erected along a circumferential direction of rotation of the reel 20 from the side wall portion 21*a*. In the accommodation part 21, a space large enough for the reel 20 to rotate is formed by the side wall portion 21*a* and the circumferential wall portion 21*b*.

In addition, the accommodation part 21 has an opening portion 21*c* that opens the other side along the axis of rotation of the reel 20 to a size that allows the reel 20 to be attached and detached and that opens a portion of the circumferential wall portion 21*b* on a front side facing the feeding path of the wire W pulled out from the reel 20.

The lid part 22 opens and closes the opening portion 21*c* of the accommodation part 21 by a rotating operation with a shaft 23 as a fulcrum. The lid part 22 is shaped to cover the opening portion 21*c* of the accommodation part 21, and has a front wall portion 22*a* on a side opposite to a side supported by the shaft 23. The front wall portion 22*a* constitutes a circumferential wall of the magazine 2 together with the circumferential wall portion 21*b* on the front side of the accommodation part 21.

The shaft 23 is supported by the circumferential wall portion 21*b* on a rear side of the accommodation part 21. A direction in which the shaft 23 extends is substantially orthogonal to the axis of rotation of the reel 20 accommodated in the magazine 2.

The magazine 2 includes a first urging member 24*a* for urging the lid part 22 in an opening direction. In addition, the magazine 2 includes a second urging member 24*b* for urging the lid part 22 in a first direction denoted with an arrow B1, which is one direction along the extension direction of the shaft 23.

The first urging member 24*a* is configured by, for example, a torsion coil spring inserted into the shaft 23, and urges the lid part 22 in the opening direction by elastically deforming in a twisting direction. In addition, the second urging member 24*b* is configured by, for example, a coil spring inserted into the shaft 23, and urges the lid part 22 in the first direction denoted with the arrow B1 along the extension direction of the shaft 23 by elastically deforming in directions of expansion and contraction.

The magazine 2 includes a lock member 25 that is movable between a closed position where the lid part 22 is kept in a closed state and an open position where it is retracted to a position where the lid part 22 can be opened and closed. The lock member 25 is an example of one regulating portion among a plurality of regulating portions that regulate opening of the lid part 22 from a closed state, has one end rotatably supported in the accommodation part 21 by a shaft 25*a*, and moves between a closed position shown in FIGS. 1A and 1B and an open position shown in FIGS. 3A and 3B by a rotating operation with the shaft 25*a* as a fulcrum.

In addition, the lock member 25 has an operating portion 25*b* that is provided at the other end portion on an opposite side to the shaft 25*a* and pushes the lid part 22 in a second direction denoted with an arrow B2, which is the other direction along the extension direction of the shaft 23, when the lock member 25 is moved to the closed position.

The lid part 22 has a pressed portion 22*b* along a locus of the rotating operation of the lock member 25 with the shaft 25*a* as a fulcrum, at a first position on one side along the extension direction of the shaft 23.

The pressed portion 22*b* is an example of one regulating portion among the plurality of regulating portions for regulating opening of the lid part 22 from the closed state, and is constituted by a surface substantially orthogonal to the extension direction of the shaft 25*a* of the lock member 25.

The magazine 2 is configured such that when the lock member 25 is moved to the closed position with the lid part 22 being closed, the lock member 25 comes into contact with the pressed portion 22*b* of the lid part 22, and the lid part 22 is kept in the closed state.

In addition, the lid part 22 includes an operated portion 22*c* along a locus of the operating portion 25*b* made by the rotating operation of the lock member 25 with the shaft 25*a* as a fulcrum.

The operated portion 22*c* is constituted by a surface whose distance from the shaft 25*a* of the lock member 25 changes, and is configured such that when the lock member 25 is moved to the closed position, the vicinity of a portion with which the operating portion 25*b* of the lock member 25 comes into contact is shorter in distance from the shaft 25*a* of the lock member 25 than the other portions.

The operated portion 22*c* receives a force of pushing the lid part 22 in the second direction denoted with the arrow B2, which is the other direction along the extension direction of the shaft 23, when the operating portion 25*b* of the lock member 25 comes into contact with a portion where the distance from the shaft 25*a* becomes shorter as the lock member 25 is moved to the closed position. Note that, in the operated portion 22*c*, a portion at which the distance from the shaft 25*a* is the shortest may be formed to have a predetermined length along the rotation direction of the lock member 25 moving to the closed position. In addition, the shaft 25*a* may be provided with a clutch or the like so that the lock member 25 moved to the closed position can be suppressed from unintentionally returning to the open position.

The reinforcing bar binding machine 1A includes a regulating portion 26 that keeps the lid part 22 in the closed state when the lid part 22 is pushed in the second direction denoted with the arrow B2, which is the other direction along the extension direction of the shaft 23, as the lock member 25 is moved to the closed position.

The regulating portion 26 is an example of one regulating portion among a plurality of regulating portions that regulate opening of the lid part 22 from the closed state, and includes a locking portion 26*a* provided on the lid part 22 and a locked portion 26*b* provided on the main body part 10, the locking portion 26*a* being locked to the locked portion 26*b*. The regulating portion 26 is provided on a downstream side of the axis of rotation of the reel 20 in the feeding path of the wire W that is fed in a forward direction denoted with an arrow F.

The lid part 22 is supported to be movable along the extension direction of the shaft 23 in the second direction denoted with the arrow B2 in which the locking portion 26*a* is locked to the locked portion 26*b* and in the first direction denoted with the arrow B1 in which a locked state of the locking portion 26*a* and the locked portion 26*b* is released.

The locking portion 26*a* is provided at a second position on the other side of the lid part 22 along the extension direction of the shaft 23, and is integrally formed with the front wall portion 22*a* of the lid part 22. The locking portion 26*a* is configured by a convex portion protruding from an end portion of the front wall portion 22*a* in the second direction denoted with the arrow B2, which is the other direction along the extension direction of the shaft 23.

The locked portion 26*b* is provided on a cover part 10*a* constituting the exterior of a part of the main body part 10 for covering feeding gears 30 and the like described below of the wire feeding unit 3, and is configured by providing a concave portion having a shape matching with the locking portion 26*a* at a portion facing the locking portion 26*a* when the lid part 22 is put into the closed state.

For the regulating portion 26, a protruding height of the locking portion 26*a* from the front wall portion 22*a* is set so that the locking portion 26*a* does not fit into the locked portion 26*b* in a state in which the lid part 22 is urged and moved by the second urging member 24*b* in the first direction denoted with the arrow B1. In contrast, the regulating portion 26 is configured such that, when the lid part 22 in the closed state is pushed in the second direction denoted with the arrow B2, the locking portion 26*a* fits into the locked portion 26*b* to keep the lid part 22 in the closed state.

Figure 4A:
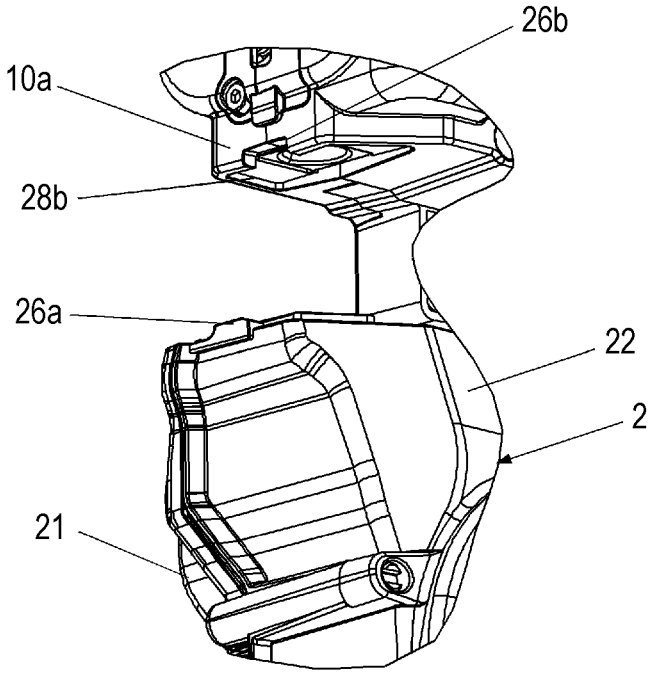
FIG. 4A is an exploded perspective view showing an example of a regulating portion of the present embodiment for regulating the magazine in a closed state.
Figure 4B:
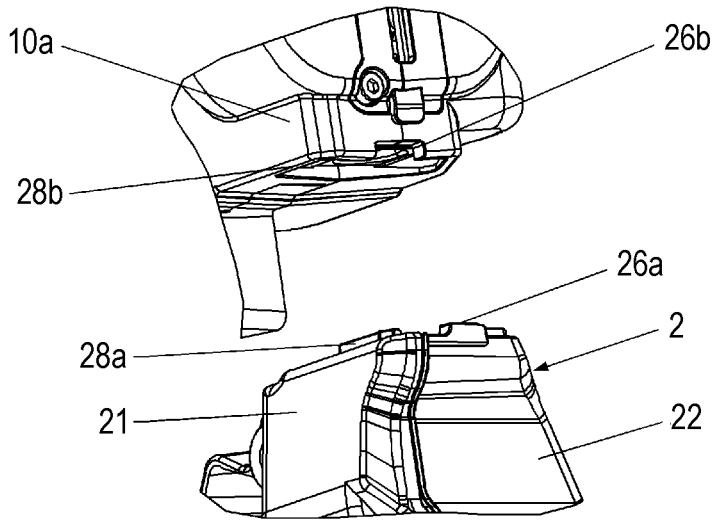
FIG. 4B is an exploded perspective view showing the example of the regulating portion of the present embodiment for regulating the magazine in the closed state.
Figure 4C:
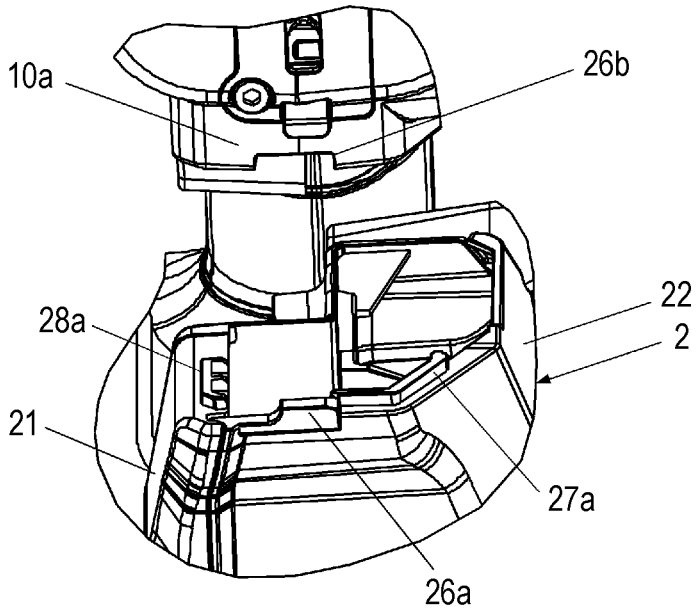
FIG. 4C is an exploded perspective view showing the example of the regulating portion of the present embodiment for regulating the magazine in the closed state.
Figure 4D:
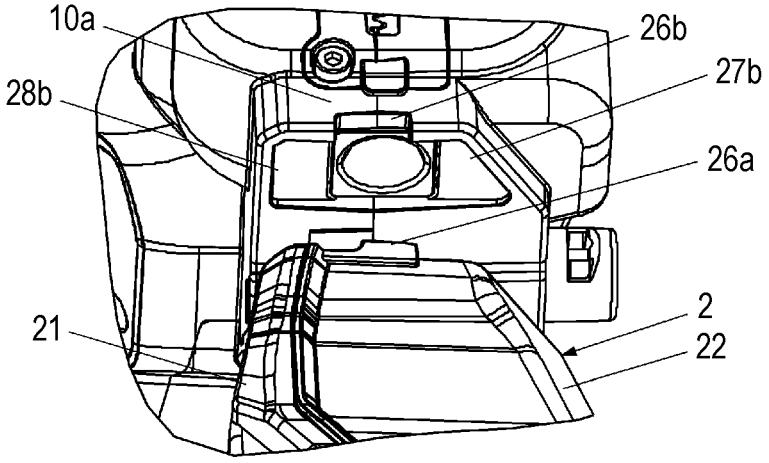
FIG. 4D is an exploded perspective view showing the example of the regulating portion of the present embodiment for regulating the magazine in the closed state.

Here, as shown in FIGS. 4C and 4D, the magazine 2 may include another locking portion 27*a*, in addition to the locking portion 26*a*, by providing a convex portion connecting to a side portion from the front wall portion 22*a* at a second position on the other side of the lid part 22 along the extension direction of the shaft 23. In addition, the main body part 10 may include another locked portion 27*b*, in addition to the locked portion 26*b*, by providing a concave portion having a shape matching the locking portion 27*a* at a portion of the cover part 10*a* facing the locking portion 27*a* when the lid part 22 is put into the closed state.

Further, the magazine 2 is provided with a locking convex portion 28*a* at a position of the accommodation part 21 facing the cover part 10*a*, and is also provided with a locking concave portion 28*b*, to which the locking convex portion 28*a* is fitted, on the cover part 10*a*, so that the accommodation part 21 is suppressed from deforming in a direction of opening with respect to the lid part 22.

Note that, in the above embodiment, the locking portion 26*a* is configured as a convex portion and the locked portion 26*b* is configured as a concave portion, and the locking portion 26*a* is locked to the locked portion 26*b* by means of concavo-convex fitting. However, the locking portion 26*a* may be configured as a concave portion and the locked portion 26*b* may be configured as a convex portion.

In addition, in the above embodiment, the locked portion 26*b* is provided on the main body part 10. In contrast, in a configuration in which a portion facing an end portion of the front wall portion 22*a* of the lid part 22 in a state in which the lid part 22 is closed is constituted as a portion of the accommodation part 21, a configuration is also possible in which the locking portion 26*a* is provided on the lid part 22 and the locked portion 26*b*, to which the locking portion 26*a* is locked, is provided on the accommodation part 21.

Next, the other configurations of the reinforcing bar binding machine 1A will be described. The wire feeding unit 3 includes a pair of feeding gears 30 that sandwiches and feeds the wire W. The wire feeding unit 3 is configured such that a rotating operation of a feeding motor (not shown) is transmitted to rotate the feeding gears 30. Thereby, the wire feeding unit 3 feeds the wire W sandwiched between the pair of feeding gears 30 along an extension direction of the wire W. In a configuration in which a plurality of, for example, two wires W are fed to bind the reinforcing bars S, the two wires W are fed aligned in parallel.

The wire feeding unit 3 is configured such that a rotation direction of a motor (not shown) is switched between forward and reverse directions to switch rotation directions of the feeding gears 30, thereby feeding the wire W in the forward direction denoted with the arrow F, feeding the wire W in the reverse direction denoted with the arrow R, or switching the feeding direction of the wire W between the forward and reverse directions.

The curl forming unit 5 includes a curl guide 50 that curls the wire W fed by the wire feeding unit 3, and an induction guide 51 that guides the wire W curled by the curl guide 50 toward the binding unit 7. In the reinforcing bar binding machine 1A, the path of the wire W that is fed by the wire feeding unit 3 is regulated by the curl forming unit 5, so that a locus of the wire W becomes a loop Ru as shown with a dashed-two dotted line in FIG. 1A and the wire W is thus wound around the reinforcing bars S.

The cutting unit 6 includes a movable blade part 61, and a transmission mechanism 62 that transmits an operation of the binding unit 7 to the movable blade part 61. The cutting unit 6 cuts the wire W by a rotating operation of the movable blade part 61 about a fixed blade part (not shown) as a fulcrum shaft. The transmission mechanism 62 is configured by a cam, a link, and the like.

The binding unit 7 includes a wire locking body 70 to which the wire W is locked. A detailed embodiment of the binding unit 7 will be described below. The drive unit 8 includes a motor 80 as a second drive unit, and a decelerator 81 that performs deceleration and amplification of torque.

The reinforcing bar binding machine 1A includes a feeding regulation part 90 against which a tip end of the wire W is butted, on a feeding path of the wire W that is locked by the wire locking body 70. In addition, in the reinforcing bar binding machine 1A, the curl guide 50 and the induction guide 51 of the curl forming unit 5 are provided at an end portion on a front side of the main body part 10. Further, in the reinforcing bar binding machine 1A, a butting portion 91 against which the reinforcing bars S are to be butted is provided at an end portion on the front side of the main body part 10 and between the curl guide 50 and the induction guide 51.

Further, in the reinforcing bar binding machine 1A, the handle part 11 extends downward from the main body part 10. In addition, a battery 15 is detachably mounted to a lower part of the handle part 11. In addition, in the reinforcing bar binding machine 1A, the magazine 2 is provided in front of the handle part 11.

In the reinforcing bar binding machine 1A, a trigger 12 is provided on a front side of the handle part 11, and a switch 13 is provided inside the handle part 11. In the reinforcing bar binding machine 1A, a control unit (not shown) controls the feeding motor and the motor 80, in response to a state of the switch 13 that is pressed by an operation on the trigger 12.

Figure 5A:
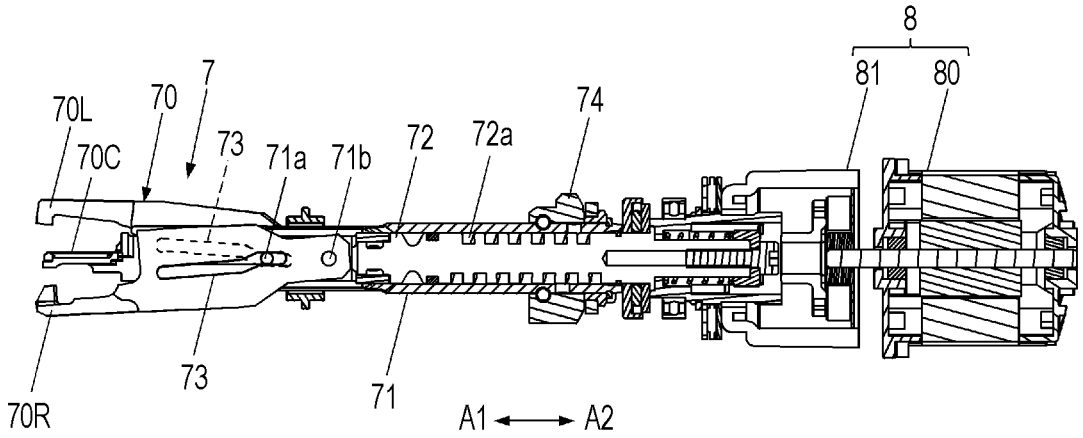
FIG. 5A is a sectional plan view showing an example of a binding unit.
Figure 5B:
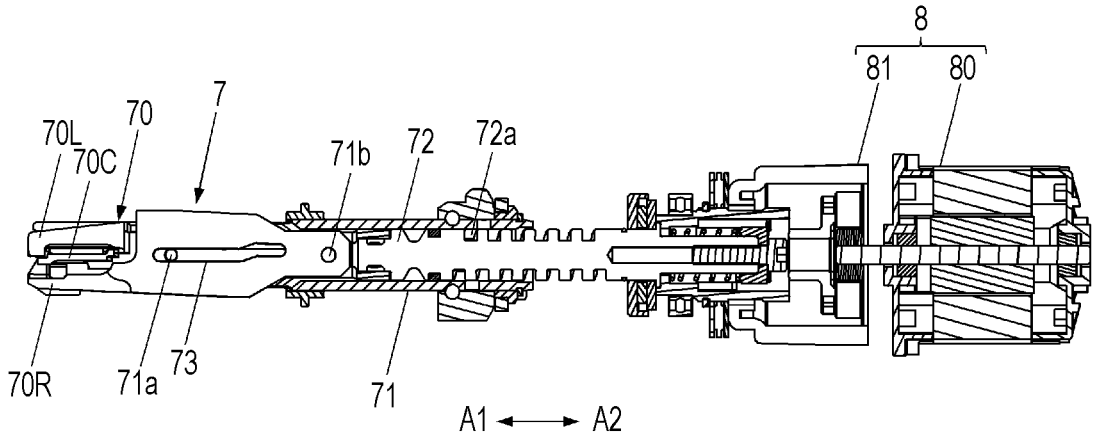
FIG. 5B is a sectional plan view showing the example of the binding unit.

FIGS. 5A and 5B are sectional plan views showing an example of the binding unit. Next, a configuration of the binding unit will be described with reference to each drawing.

The binding unit 7 includes a rotary shaft 72 that actuates the wire locking body 70 and a sleeve 71. The binding unit 7 and the drive unit 8 are configured such that the rotary shaft 72 and the motor 80 are connected via the decelerator 81 and the rotary shaft 72 is driven by the motor 80 via the decelerator 81.

The wire locking body 70 includes a center hook 70C connected to the rotary shaft 72, and a first side hook 70R and a second side hook 70L that open/close with respect to the center hook 70C.

The center hook 70C is connected to a tip end of the rotary shaft 72, which is one end portion along an axis direction of the rotary shaft 72, via a configuration that can rotate with respect to the rotary shaft 72 and move in the axis direction integrally with the rotary shaft 72.

The wire locking body 70 opens/closes in directions in which the tip end side of the first side hook 70R is contacted/separated with respect to the center hook 70C by a rotating operation about a shaft 71*b* as a fulcrum. The wire locking body also opens/closes in directions in which the tip end side of the second side hook 70L is contacted/separated with respect to the center hook 70C.

The sleeve 71 has a convex portion (not shown) protruding from an inner circumferential surface of a space in which the rotary shaft 72 is inserted, and the convex portion enters a groove portion of a feeding screw 72*a* formed along the axis direction on an outer circumference of the rotary shaft 72. When the rotary shaft 72 rotates, the sleeve 71 moves in a direction along the axis direction of the rotary shaft 72, according to a rotation direction of the rotary shaft 72 by an action of the convex portion (not shown) and the feeding screw 72*a* of the rotary shaft 72. The sleeve 71 also rotates integrally with the rotary shaft 72.

The sleeve 71 has an opening/closing pin 71*a* that opens/closes the first side hook 70R and the second side hook 70L.

The opening/closing pin 71*a* is inserted into opening/closing guide holes 73 formed in the first side hook 70R and the second side hook 70L. The opening/closing guide hole 73 has a shape of extending along a moving direction of the sleeve 71 and converting a linear motion of the opening/closing pin 71*a* that moves in conjunction with the sleeve 71 into an opening/closing operation by rotation of the first side hook 70R and the second side hook 70L about the shaft 71*b* as a fulcrum.

The wire locking body 70 is configured such that, when the sleeve 71 is moved in a direction of an arrow A2, the first side hook 70R and the second side hook 70L are moved away from the center hook 70C by the rotating operation about the shaft 71*b* as a fulcrum, due to a locus of the opening/closing pin 71*a* and the shape of the opening/closing guide holes 73.

Thereby, the first side hook 70R and the second side hook 70L are opened with respect to the center hook 70C, so that a feeding path through which the wire W passes is formed between the first side hook 70R and the center hook 70C and between the second side hook 70L and the center hook 70C.

In a state where the first side hook 70R and the second side hook 70L are opened with respect to the center hook 70C, the wire W that is fed by the wire feeding unit 3 passes between the center hook 70C and the first side hook 70R. The wire W passing between the center hook 70C and the first side hook 70R is guided to the curl forming unit 5. Then, the wire W curled by the curl forming unit 5 and guided to the binding unit 7 passes between the center hook 70C and the second side hook 70L.

The wire locking body 70 is configured such that, when the sleeve 71 is moved in a direction of an arrow A1, the first side hook 70R and the second side hook 70L are moved toward the center hook 70C by the rotating operation about the shaft 71*b* as a fulcrum, due to the locus of the opening/closing pin 71*a* and the shape of the opening/closing guide holes 73. Thereby, the first side hook 70R and the second side hook 70L are closed with respect to the center hook 70C.

When the first side hook 70R is closed with respect to the center hook 70C, the wire W sandwiched between the first side hook 70R and the center hook 70C is locked in such an aspect that the wire can move between the first side hook 70R and the center hook 70C. In addition, when the second side hook 70L is closed with respect to the center hook 70C, the wire W sandwiched between the second side hook 70L and the center hook 70C is locked in such an aspect that the wire does not come off between the second side hook 70L and the center hook 70C.

The sleeve 71 has a bending portion 71*c*1 that pushes and bends a tip end side (one end portion) of the wire W in a predetermined direction to form the wire W into a predetermined shape, and a bending portion 71*c*2 that pushes and bends a terminal end side (other end portion) of the wire W cut by the cutting unit 6 in a predetermined direction to form the wire W into a predetermined shape.

The sleeve 71 is moved in the direction of the arrow A1, so that the tip end side of the wire W locked by the center hook 70C and the second side hook 70L is pushed and bent toward the reinforcing bars S by the bending portion 71*c*1. In addition, the sleeve 71 is moved in the direction of the arrow A1, so that the terminal end side of the wire W locked by the center hook 70C and the first side hook 70R and cut by the cutting unit 6 is pushed and bent toward the reinforcing bars S by the bending portion 71*c*2.

The binding unit 7 includes a rotation regulation part 74 that regulates rotations of the wire locking body 70 and the sleeve 71 that are rotated in conjunction with the rotating operation of the rotary shaft 72. In the binding part 7, the rotation regulation part 74 regulates rotation of the sleeve 71 that is rotated in conjunction with rotation of the rotary shaft 72, according to a position of the sleeve 71 along an axial position of the rotary shaft 72, so that the sleeve 71 is moved in the direction of the arrow A1 and the direction of the arrow A2 by the rotating operation of the rotary shaft 72.

Thereby, the sleeve 71 moves in the direction of the arrow A1 without rotating, so that the first side hook 70R and the second side hook 70L are closed with respect to the center hook 70C, and the wire W is locked. In addition, the sleeve 71 moves in the direction of the arrow A2 without rotating, so that the first side hook 70R and the second side hook 70L are opened with respect to the center hook 70C, and the locking of the wire W is released.

The binding unit 7 is configured such that when the rotation regulation on the sleeve 71 by the rotation regulation part 74 is released, the sleeve 71 is rotated in conjunction with the rotation of the rotary shaft 72.

Thereby, the first side hook 70R and second side hook 70L and the center hook 70C locking the wire W are rotated to twist the locked wire W.

Figure 6A:
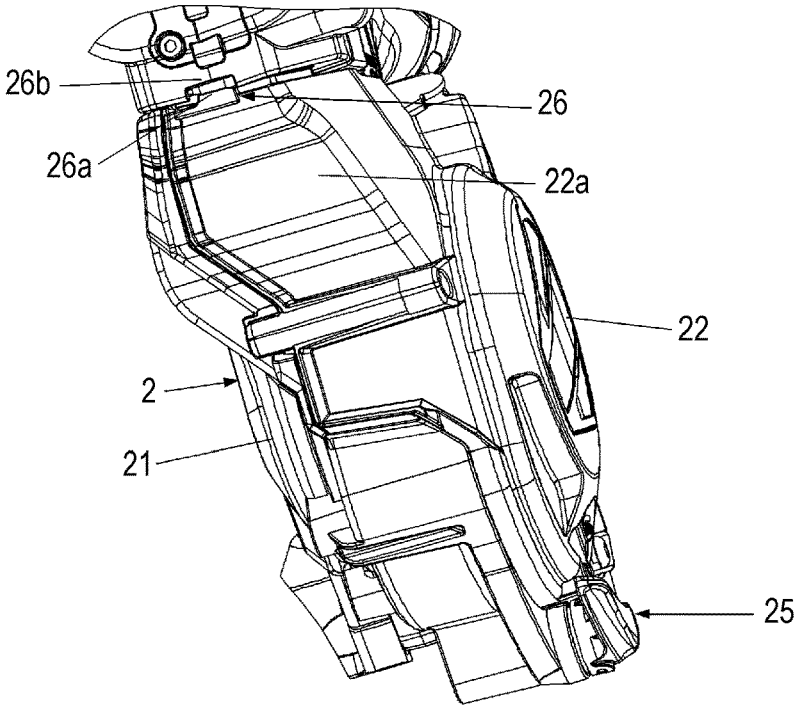
FIG. 6A is a perspective view showing an example of an operation of enabling the magazine to be opened and closed.
Figure 6B:
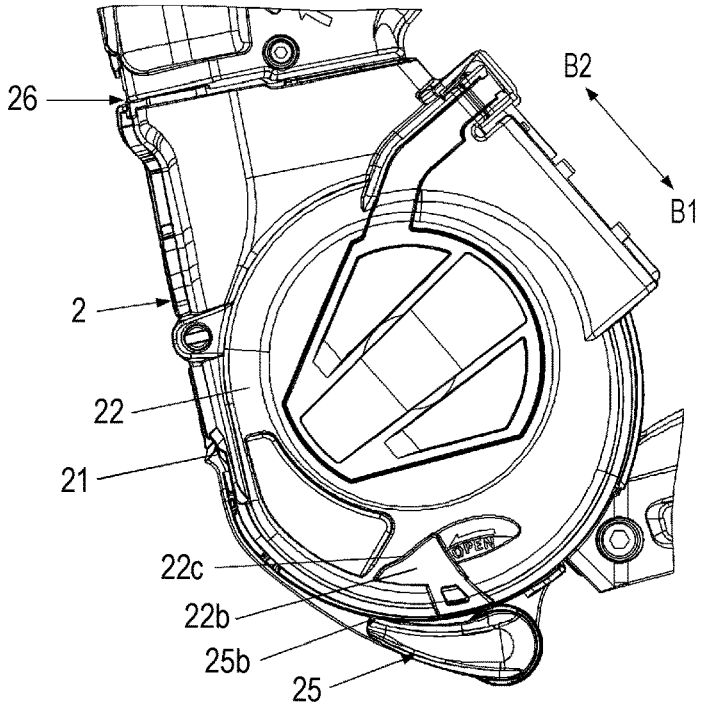
FIG. 6B is a side view showing the example of the operation of enabling the magazine to be opened and closed.
Figure 7A:
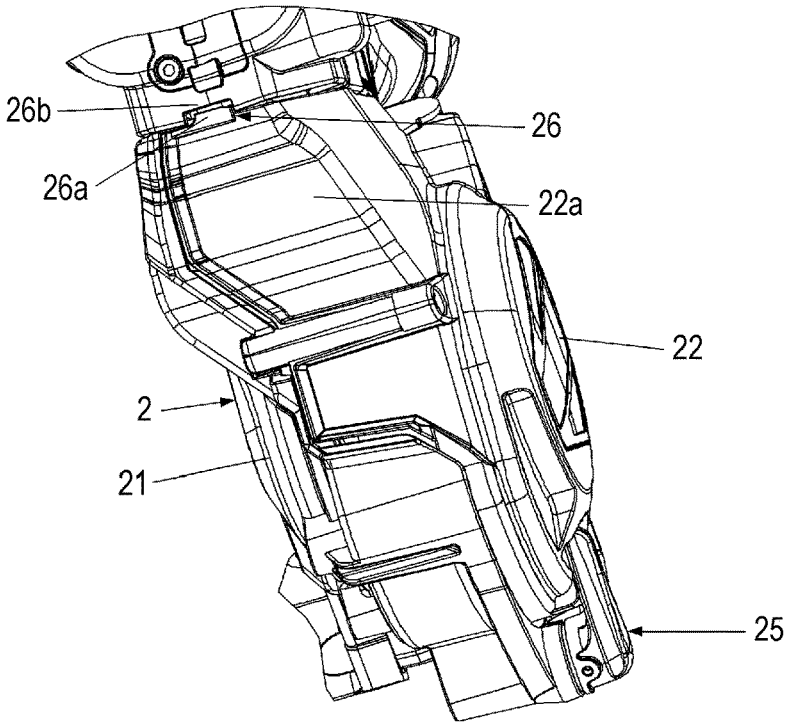
FIG. 7A is a perspective view showing an example of an operation of putting the magazine into the closed state.
Figure 7B:
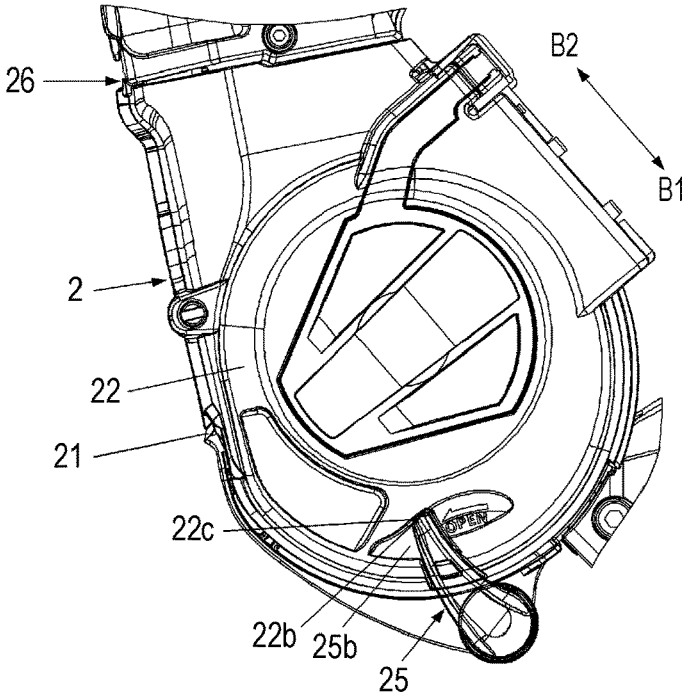
FIG. 7B is a side view showing the example of the operation of putting the magazine into the closed state.

Example of Operation of Reinforcing Bar Binding Machine of Present Embodiment FIG. 6A is a perspective view showing an example of an operation of enabling the magazine to be opened and closed, and FIG. 6B is a side view showing the example of the operation of enabling the magazine to be opened and closed. In addition, FIG. 7A is a perspective view showing an example of an operation of putting the magazine into the closed state, and FIG. 7B is a side view showing the example of the operation of putting the magazine into the closed state. Next, an operation of opening/closing the lid part 22 of the magazine 2 will be described with reference to the respective drawings.

In the magazine 2, as shown in FIGS. 6A and 6B, when the lock member 25 is moved to the open position, the operating portion 25*b* of the lock member 25 separates from the operated portion 22*c* of the lid part 22. Thereby, a force of pressing the lid part 22 with the operating portion 25*b* of the lock member 25 in the second direction denoted with the arrow B2, which is the other direction along the extension direction of the shaft 23, is not generated.

Therefore, in the magazine 2, when the lock member 25 is moved to the open position, the lid part 22 is urged and moved by the second urging member 24*b* in the first direction denoted with the arrow B1, which is one direction along the extension direction of the shaft 23.

For the regulating portion 26, in a state where the lid part 22 is urged and moved by the second urging member 24*b* in the first direction denoted with the arrow B1, the locking portion 26*a* is moved to a position where it does not fit into the locked portion 26*b*, and therefore, does not interfere with the opening/closing of the lid part 22. Therefore, by opening the lid part 22, the reel 20 can be loaded, replaced, or the like. Note that a configuration in which the second urging member 24*b* is not provided is also possible. In this case, when an operator moves the lid part 22 in the first direction denoted with the arrow B1, which is one direction along the extension direction of the shaft 23, the locking portion 26*a* is moved to a position where it does not fit into the locked portion 26*b*, and therefore, does not interfere with the opening/closing of the lid part 22.

In contrast, as shown in FIGS. 7A and 7B, in the magazine 2, when the lock member 25 is moved to the closed position with the lid part 22 being closed, and thus, the operated portion 22*c* of the lid part 22 is pushed by the operating portion 25*b* of the lock member 25, the lid part 22 is pushed in the second direction denoted with the arrow B2, which is the other direction along the extension direction of the shaft 23.

For the regulating portion 26, when the lid part 22 in the closed state is pushed in the second direction denoted with the arrow B2, the locking portion 26*a* fits into the locked portion 26*b* to keep the lid part 22 in the closed state. Note that in the case where the lid part 22 is provided with another locking portion 27*a* and the cover part 10*a* is provided with another locked portion 27*b*, as shown in FIGS. 4C and 4D, when the lid part 22 in the closed state is pushed in the second direction denoted with the arrow B2, another locking portion 27*a* fits into another locked portion 27*b* to keep the lid part 22 in the closed state.

Thereby, in the magazine 2, the lock member 25 is moved to the closed position with the lid part 22 being closed, so that the first position of the lid part 22 on one side along the extension direction of the shaft 23 is kept closed by the lock member 25. In addition, in the magazine 2, the second position of the lid part 22 on the other side along the extension direction of the shaft 23 is kept closed by the regulating portion 26.

Subsequently, an operation of binding the reinforcing bars S with the wire W by the reinforcing bar binding machine 1A of the present embodiment will be described with reference to each drawing.

The reinforcing bar binding machine 1A is in a standby state where the wire W is sandwiched between the pair of feeding gears 30 and the tip end of the wire W is located between a sandwiched position by the feeding gears 30 and the cutting unit 6. In addition, in the reinforcing bar binding machine 1A, in the standby state, as shown in FIG. 5A and the like, the first side hook 70R is opened with respect to the center hook 70C, and the second side hook 70L is opened with respect to the center hook 70C.

When the reinforcing bars S are inserted between the curl guide 50 and the induction guide 51 of the curl forming unit 5 and the trigger 12 is operated to push the switch 13, the wire W is fed in the forward direction denoted with the arrow F by the wire feeding unit 3.

In a configuration where a plurality of, for example, two wires W are fed, the two wires W are fed aligned in parallel along an axis direction of the loop Ru formed by the wires W.

The wire W fed in the forward direction passes between the center hook 70C and the first side hook 70R, and is then fed to the curl guide 50 of the curl forming unit 5. The wire W passes through the curl guide 50 and is thus curled to be wound around the reinforcing bars S.

The wire W curled by the curl guide 50 is guided to the induction guide 51 and is further fed in the forward direction by the wire feeding unit 3, so that the wire is guided between the center hook 70C and the second side hook 70L by the induction guide 51. Then, the wire W is fed until the tip end is butted against the feeding regulation part 90.

When the front end of the wire W is fed to a position where it is butted against the feeding regulation part 90, the forward feeding of the wire W is stopped, and then the motor 80 is driven in the forward rotation direction. The rotation of the sleeve 71 that is rotated in conjunction with the rotation of the rotary shaft 72 is regulated by the rotation regulation part 74 in an operating region where the wire W is locked by the wire locking body 70. Thereby, the rotation of the motor 80 is converted into linear movement, so that the sleeve 71 is moved in the forward direction denoted with the of the arrow A1.

When the sleeve 71 is moved in the forward direction, the opening/closing pin 71*a* passes through the opening/closing guide holes 73. Thereby, the first side hook 70R is moved toward the center hook 70C by the rotating operation about the shaft 71*b* as a fulcrum. When the first side hook 70R is closed with respect to the center hook 70C, the wire W sandwiched between the first side hook 70R and the center hook 70C is locked in such an aspect that the wire can move between the first side hook 70R and the center hook 70C.

In addition, the second side hook 70L is moved toward the center hook 70C by the rotating operation about the shaft 71*b* as a fulcrum. When the second side hook 70L is closed with respect to the center hook 70C, the wire W sandwiched between the second side hook 70L and the center hook 70C is locked in such an aspect that the wire does not come off between the second side hook 70L and the center hook 70C.

As shown in FIG. 5B, after advancing the sleeve 71 to a position where the wire W is locked with the closing operation of the first side hook 70R and the second side hook 70L, the rotation of the motor 80 is temporarily stopped, and the wire W is fed in the reverse direction denoted with the arrow R. Since the tip end side of the wire W is locked in such an aspect that the wire does not come off between the second side hook 70L and the center hook 70C, the wire W is wound on the reinforcing bars S by the operation of feeding the wire W in the reverse direction.

After the feeding of the wire W in the reverse direction is stopped based on an increase in load due to the wire W being wound on the reinforcing bars S, the motor 80 is driven in the forward rotation direction, thereby further moving the sleeve 71 in the forward direction denoted with the arrow A1. The movement of the sleeve 71 in the forward direction is transmitted to the cutting unit 6 by the transmission mechanism 62, so that the movable blade part 61 is actuated to cut the wire W locked by the first side hook 70R and the center hook 70C.

By driving the motor 80 in the forward rotation direction, the sleeve 71 is moved in the forward direction denoted with the arrow A1, so that the bent portions 71*c*1 and 71*c*2 are moved toward the reinforcing bars S almost simultaneously with the cutting of the wire W. Thereby, the tip end side of the wire W locked by the center hook 70C and the second side hook 70L is pressed toward the reinforcing bars S and bent toward the reinforcing bars S at the locking position as a fulcrum by the bending portion 71*c*1. The sleeve 71 is further moved in the forward direction, so that the wire W locked between the second side hook 70L and the center hook 70C is maintained sandwiched by the bending portion 71*c*1.

In addition, the terminal end side of the wire W locked by the center hook 70C and the first side hook 70R and cut by the cutting unit 6 is pressed toward the reinforcing bars S and bent toward the reinforcing bars S at the locking position as a fulcrum by the bending portion 71*c*2. The sleeve 71 is further moved in the forward direction, so that the wire W locked between the first side hook 70R and the center hook 70C is maintained sandwiched by the bending portion 71*c*2.

After the tip end side and the terminal end side of the wire W are bent toward the reinforcing bars S, the motor 80 is further driven in the forward rotation direction, so that the sleeve 71 is further moved in the forward direction. When the sleeve 71 is moved to a predetermined position, the rotation regulation on the sleeve 71 by the rotation regulation part 74 is released.

Thereby, the motor 80 is further driven in the forward rotation direction, so that the sleeve 71 is rotated in conjunction with the rotary shaft 72 and the wire W locked by the wire locking body 70 is twisted.

Based on a state where the load applied to the motor 80 is maximized as the wire W is twisted, etc., the driving in the forward rotation direction of the motor 80 is stopped, and then the motor 80 is driven in the reverse rotation direction. When the motor 80 is driven in the reverse rotation direction, the rotary shaft 72 is reversely rotated and the sleeve 71 is reversely rotated in conjunction with the reverse rotation of the rotary shaft 72, the rotation of the sleeve 71 that is rotated in conjunction with the rotation of the rotary shaft 72 is regulated by the rotation regulation blade 74. Thereby, the sleeve 71 is moved in the direction of the arrow A2, which is a backward direction.

When the sleeve 71 is moved in the backward direction, the bending portions 71*c*1 and 71*c*2 are away from the wire W, and the holding of the wire W by the bending portions 71*c*1 and 71*c*2 is released. In addition, when the sleeve 71 is moved in the backward direction, the opening/closing pin 71*a* passes through the opening/closing guide holes 73. Thereby, the first side hook 70R is moved away from the center hook 70C by the rotating operation about the shaft 71*b* as a fulcrum. In addition, the second side hook 70L is moved away from the center hook 70C by the rotating operation about the shaft 71*b* as a fulcrum. Thereby, the wire W comes off from the wire locking body 70.

Example of Operational Effects of Reinforcing Bar Binding Machine of Present Embodiment In the operation of feeding the wire W in the reverse direction in order to wind the wire W on the reinforcing bars S, the wire W loosened in the magazine 2 may cause a state called buckling in which the wire is bent between the feeding gears 30 of the wire feeding unit 3 and the reel 20.

As shown in FIGS. 1B and 2B, the magazine 2 has a configuration in which the accommodation part 21 is offset in the direction of the lid part 22 with respect to the feeding path of the wire W by the pair of feed gears 30. For this reason, when the wire W loosened in the magazine 2 causes buckling, there is a possibility that the wire W deforms in a direction approaching the lid part 22 and pushes the lid part 22 in the opening direction.

However, even when the lid part 22 is pushed in the opening direction, the lid part 22 is not opened because the lock member 25 is at the closed position.

However, in a configuration in which the regulating portion 26 is not provided, since a side of the lid part 22 close to the main body part 10, which is the other side along the extension direction of the shaft 23, is deformable in a direction away from the accommodation part 21, there is a possibility that a gap will occur between the lid part 22 and the accommodation part 21.

If a gap occurs between the lid part 22 and the accommodation part 21, there is a possibility that the reel 20 will move toward the lid part 22 in the axis direction of rotation as much as the gap. If the reel 20 moves toward the lid part 22 in the axis direction of rotation, there is a possibility that the reel 20 will not be detected in a configuration in which a sensor for detecting the presence or absence of the reel 20 provided in the accommodation part 21 is provided.

In contrast, in the configuration in which the regulating portion 26 is provided, when the lock member 25 is moved to the closed position with the lid part 22 being closed, the lid part 22 in the closed state is pushed in the second direction denoted with the arrow B2, so that the locking portion 26*a* fits into the locked holding portion 26*b*, and the lid part 22 is kept in the closed state.

Thereby, the lock member 25 is moved to the closed position with the lid part 22 being closed, so that the first position of the lid part 22 on one side along the extension direction of the shaft 23 is kept closed by the lock member 25. In addition, the second position of the lid part 22 on the other side along the extension direction of the shaft 23 is kept closed by the regulating portion 26.

Therefore, even when the lid part 22 is pushed in the opening direction, a gap is suppressed from occurring between the lid part 22 and the accommodation part 21. Therefore, the movement of the reel 20 toward the lid part 22 in the axis direction of rotation is suppressed. Thereby, it is possible to suppress a situation in which even though the reel 20 is accommodated in the magazine 2, it is erroneously determined that the reel 20 is not loaded, and an error is output to stop the operation.

Further, the regulating portion 26 is configured such that, when the lid part 22 is moved in the second direction denoted with the arrow B2 by the operation of moving the lock member 25 to the closed position, the locking portion 26*a* fits into the locked portion 26*b* to keep the lid part 22 in the closed state. Thereby, since the regulating portion 26 is operated in conjunction with the operation of the lock member 25, the operation is facilitated.

What is claimed is:

1. A binding machine comprising:

a magazine including an accommodation part configured to accommodate a reel on which a wire is wound, and a lid part configured to cover the accommodation part to be openable and closable, the accommodation part including a side wall portion and a circumferential wall portion erected from the side wall portion;

a wire feeding unit including a pair of feeding gears configured to feed the wire in a forward direction in which the wire is pulled out from the magazine and in a reverse direction in which the wire is pulled back to the magazine;

a curl forming unit including a curl guide configured to form a path along which the wire fed in the forward direction by the wire feeding unit is to be wound around an object;

a binding unit configured to twist the wire fed in the reverse direction and wound on the object by the wire feeding unit, the binding unit including a wire locking body, a sleeve, and a rotary shaft; and a plurality of regulating portions including a locking portion and a locked portion configured to match with each other by a convex portion and a concave portion, the regulating portions being configured to regulate opening of the lid part from a closed state in which the accommodation part is closed by the lid, wherein:

one of the plurality of regulating portions is a first regulating portion which has the locking portion provided on the lid part and the locked portion provided on a main body part to which the accommodation part is attached, the locking portion being configured to be locked to the locked portion, another of the plurality of regulating portions is a third regulating portion which has a lock lever configured to be movable between a closed position where the lid part is kept in a closed state and an open position where the lid part is openable, and the locking portion is locked to the locked portion by moving the lock lever to the closed position.

2. The binding machine according to claim 1, wherein one of the plurality of regulating portions is a second regulating portion which has the locking portion provided on the lid part and the locked portion provided on the accommodation part, the locking portion being configured to be locked to the locked portion.

3. The binding machine according to claim 1, wherein the lid part is supported to be movable in a first direction in which the locking portion is locked to the locked portion and in a second direction in which a locked state between the locking portion and the locked portion is released, and wherein the lid part is moved in the direction in which the locking portion is locked to the locked portion by moving the lock lever to the closed position.

4. The binding machine according to claim 1, wherein the third regulating portion has an operated portion which is configured to be pushed by the lock lever.

5. The binding machine according to claim 4, wherein the operated portion is pushed by the lock lever moving to the closed position and the lid part is moved in a first direction in which the locking portion is locked to the locked portion.

6. The binding machine according to claim 1, wherein the lock lever is configured to keep the closed state of the lid by pushing a pressed portion provided on at least one of the lid part or the accommodation part in a state where the lock lever is at a closed position.

7. The binding machine according to claim 3 further comprising a spring configured to urge the lid part in the direction in which the locked state between the locking portion and the locked portion is released.

8. The binding machine according to claim 7, wherein the lid part is configured to open and close the accommodation part by a rotation operation of the lid part with a shaft as a fulcrum, and wherein the spring is provided along the shaft.

9. The binding machine according to claim 1, wherein the lid part is configured to open and close the accommodation part by a rotating operation of the lid part with a shaft as a fulcrum, and wherein the plurality of regulating portions are configured to regulate opening of the lid part from the closed state in which the accommodation part is closed, at one side and the other side of the lid part in an extension direction of the shaft.

10. The binding machine according to claim 9, wherein one of the regulating portions is disposed at the one side of the lid part in an extension direction of the shaft, and wherein another of the regulating portions is disposed at the other side of the lid part in an extension direction of the shaft.

11. A binding machine comprising:

a magazine having an accommodation part configured to accommodate a reel on which a wire is wound, and a lid part configured to cover the accommodation part to be openable and closable, the accommodation part including a side wall portion and a circumferential wall portion erected from the side wall portion;

a wire feeding unit including a pair of feeding gears configured to feed the wire in a forward direction in which the wire is pulled out from the magazine and in a reverse direction in which the wire is pulled back to the magazine;

a curl forming unit including a curl guide configured to form a path along which the wire fed in the forward direction by the wire feeding unit is to be wound around an object;

a binding unit configured to twist the wire fed in the reverse direction and wound on the object by the wire feeding unit, the binding unit including a wire locking body, a sleeve, and a rotary shaft; and a regulating portion provided on a downstream side of an axis of rotation of the reel in a feeding path of the wire that is fed in a forward direction, including a locking portion and a locked portion configured to match with each other by a convex portion and a concave portion, and configured to regulate opening of the lid part from a closed state in which the accommodation part is closed by the lid; and another regulating portion provided on an upstream side of the axis of rotation of the reel in the feeding path of the wire that is fed in the forward direction, wherein the lid is configured to move toward the downstream side by moving a lock member of another regulating portion from an open position where the lid part is openable to a closed position where the lid part is kept in a closed state.

* * * * *